US007156975B2

(12) United States Patent
Sato et al.

(10) Patent No.: US 7,156,975 B2
(45) Date of Patent: Jan. 2, 2007

(54) POLISHING METHOD AND ELECTROPOLISHING APPARATUS

(75) Inventors: Shuzo Sato, Kanagawa (JP); Takeshi Nogami, Kanagawa (JP); Zenya Yasuda, Kanagawa (JP); Masao Ishihara, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/304,174

(22) Filed: Nov. 26, 2002

(65) Prior Publication Data

US 2003/0104762 A1 Jun. 5, 2003

(30) Foreign Application Priority Data

Nov. 30, 2001 (JP) ..... P2001-366341

(51) Int. Cl.

| | |
|---|---|
| ***C25F 3/16*** | (2006.01) |
| ***C25F 7/00*** | (2006.01) |
| ***B23H 5/06*** | (2006.01) |
| ***B23H 3/02*** | (2006.01) |
| *C25F 3/22* | (2006.01) |

(52) U.S. Cl. ..... 205/644; 205/663; 204/228.7; 204/229.8

(58) Field of Classification Search ..... 205/640, 205/641, 644, 645; 204/229.8
See application file for complete search history.

(56) References Cited

U.S. PATENT DOCUMENTS

| | | | | |
|---|---|---|---|---|
| 4,358,338 | A * | 11/1982 | Downey et al. | 204/192.33 |
| 4,793,895 | A * | 12/1988 | Kaanta et al. | 438/17 |
| 5,807,165 | A * | 9/1998 | Uzoh et al. | 451/41 |
| 6,315,883 | B1 * | 11/2001 | Mayer et al. | 205/123 |
| 6,379,223 | B1 * | 4/2002 | Sun et al. | 451/41 |
| 6,402,592 | B1 * | 6/2002 | Zhu et al. | 451/36 |
| 6,736,699 | B1 | 5/2004 | Nogami et al. | |
| 6,808,617 | B1 | 10/2004 | Sato et al. | |
| 2003/0062269 | A1 | 4/2003 | Sharan | |
| 2003/0136684 | A1 * | 7/2003 | Duboust et al. | 205/640 |

* cited by examiner

*Primary Examiner*—Harry D Wilkins, III
(74) *Attorney, Agent, or Firm*—Robert J. Depke; Rockey, Depke, Lyons & Kitzinger LLC

(57) ABSTRACT

A polishing method for electropolishing a metal film formed on a wafer surface so as to fill concave portions formed on the wafer surface comprises a step of determining an electropolishing end point of the metal film on the basis of a change of a current waveform resulting from electropolishing the metal film. An electropolishing apparatus comprising a current detector for detecting a current waveform resulting from electropolishing a metal film and an end point determination part for determining an electropolishing end point of the metal film on the basis of the change of a current detected with the current detector is used to realize the polishing method.

6 Claims, 7 Drawing Sheets

FIG. 4

① CMP P=280g/cm$^2$

C C C C

12 MIN. IN TOTAL — SEQUENCE OF 3 MIN×4

QUANTITY REMOVED BY CMP — 3000×4=12000Å

QUANTITY REMOVED BY ELECTROPOLISHING — 0

② LOW PRESSURE CMP P=60g/cm$^2$

C C C C C C C C ··· C C C C C

48 MIN. IN TOTAL — SEQUENCE OF 3 MIN×16

QUANTITY REMOVED BY CMP — 750×16=12000Å

QUANTITY REMOVED BY ELECTROPOLISHING — 0

③ ELECTROPOLISHING+LOW PRESSURE CMP P=60g/cm$^2$

C E C E C E C E C E C C C

24 MIN AND 50 SEC IN TOTAL — SEQUENCE OF 3 MIN×8+ ELECTROPOLISHING

QUANTITY REMOVED BY CMP — 750×8=6000Å

QUANTITY REMOVED BY ELECTROPOLISHING — 166.6×5=833Å

C — NORMAL PRESSURE CMP FOR 3 MIN
RATE: ABOUT 1000Å/MIN
QUANTITY REMOVED: 3000Å/EACH PROCESS

C — LOW PRESSURE CMP FOR 3 MIN
RATE: ABOUT 250Å/MIN
QUANTITY REMOVED: 750Å/EACH PROCESS

C — OVERPOLISH AFTER BARRIER IS EXPOSED

E — ELECTROPOLISHING FOR 10 SEC
RATE: ABOUT 1000Å/MIN
QUANTITY REMOVED: 166.6Å/EACH PROCESS

POLISHING METHOD AND ELECTROPOLISHING APPARATUS

CROSS REFERENCES TO RELATED APPLICATIONS

The present document is based on Japanese Priority Document JP 2001-366341, filed in the Japanese Patent Office on Nov. 30, 2001, the entire contents of which being incorporated herein by reference.

BACKGROUND OF THE INVENTION

1. Field of the Invention

This invention relates to a polishing method and an electropolishing apparatus, and more specifically, a polishing method for accurately determining an end point in an electropolishing required for a case of forming embedded wirings by planarization of concave and convex portions of a copper-plated film surface with a process of forming copper interconnections, a polishing method for polishing by alternating the electropolishing with a chemical mechanical polishing repeatedly, and an electropolishing apparatus for accurately determining an electropolishing end point.

2. Description of Related Art

A detection of an end point in a process of electropolishing a copper-plated film used for copper interconnections has been managed on the basis of a polish time.

However, an electropolishing causes a local increase of a solve-out rate of copper by reason that a micro interconnection portion is electropolished centrally with a decreasing area of a remaining copper film portion. Thus, there is a narrow margin of detection of the end point when a determination on the end point is made by a time management, so that the electropolishing still presents problems such as a disappearance of micro interconnections and a presence of macro interconnection remains.

Further, a mere conjecture on a quantity of removed copper from a cumulative value of integrating currents finds difficulty in determining an accurate end point, because of a local resistance change attributable to a concentration of currents, in addition to a fact that a current value in the end point is far smaller than that at a time when a whole surface was covered with copper.

As a result, the following problems occur. That is, (1) a polished surface of the copper film constitutes an unstable surface having a poor surface smoothness, (2) there is provided an insufficient interconnection sectional area attributable to a recessed copper interconnection surface as a result of overpolish of copper filled in a trench interconnection portion, (3) a dishing occurs, (4) an erosion occurs and the like. A local non-uniformity caused by the presence of copper remains, the overpolish of the copper and the like as described above produces short circuit failure and/or open circuit failures of interconnections.

In particular, when the trench interconnection portion is the only portion to be electropolished in the end point, a polished area of a copper film is decreased with a decreasing area of a copper surface from a state of 100% that the entire surface is initially covered with copper up to a pattern density. For this reason, the copper in a micro trench interconnection portion is liable to be electropolished centrally, so that a polish rate of an independent micro interconnection portion is increased in an accelerating manner with an increasing polish rate difference between a macro remaining portion or a wide interconnection portion and the independent micro interconnection portion. In addition, variations of electropolishing conditions depending on an extreme change of an anode current density, as well as a deviation from bright electropolishing conditions, produce a poor surface such as a rough surface.

SUMMARY OF THE INVENTION

Accordingly, there is a need for a polishing method and an electropolishing apparatus that are provided according to the present invention in order to solve the above problems.

In a polishing method for electropolishing a metal film formed on a wafer surface having convex and concave patterns so as to fill concave portions on the wafer surface, a first polishing method according to the present invention comprises a step of determining an electropolishing end point of the metal film on the basis of a change of a current waveform resulting from electropolishing the metal film. The electropolishing end point is found by differentiation of the change of the current waveform in an electropolishing.

According to the first polishing method, since a characteristic feature of a current waveform obtainable in the electropolishing is used to determine the electropolishing end point of the metal film on the basis of the change of the current waveform resulting from electropolishing the metal film, the electropolishing end point can be determined accurately. In a case of forming copper trench interconnections, the copper trench interconnections are normally connected together through interconnections, elements and the like that are formed in a lower layer. For this reason, even if the electropolishing is advanced with a result that insular-shaped copper film portions are left behind, each insular-shaped copper film portion left behind is placed in an electrically connected state through the interconnections, the elements and the like that are formed in the lower layer, so that a current applied in the electropolishing changes continuously. Then, when the electropolishing is further advanced up to a stage that a substrate of the copper film begins to be exposed to the outside, the current applied in the electropolishing sharply drops in the shape of a characteristic curve to a polish time, because of a sharp rise of a resistance of an electropolished film (the copper film). Thus, the electropolishing end point is determined accurately on the basis of a change of a current-time curve such as a value obtained by differentiating the current-time curve, for instance. Accordingly, the metal film is prevented from being electropolished insufficiently or to excess, with the consequence that desired trench interconnections can be formed.

In a polishing method for polishing a metal film formed on a wafer surface so as to fill concave portions formed on the wafer surface, a second polishing method according to the present invention comprises a step of polishing the metal film by alternating an electropolishing with a chemical mechanical polishing or chemical buffing. An electropolishing end point in the second polishing method may be determined using an end point detection means in the first polishing method.

According to the second polishing method, since the metal film is polished by alternating the electropolishing with the chemical mechanical polishing or chemical buffing, a metal film surface is roughened by the electropolishing, so that there is obtained a high polish rate in the chemical mechanical polishing or chemical buffing subsequent to the electropolishing. Since the electropolished surface is further polished by the chemical mechanical polishing or chemical buffing, it is possible to obtain a polished surface of a quality as smooth as a surface polished merely by the chemical mechanical polishing or chemical buffing, in addition to the high polish rate. Further, since the electropolishing and the chemical mechanical polishing or chemical buffing are alternated with each other, it is also possible to obtain the high polish rate without losing the quality of the polished surface.

In an electropolishing apparatus for electropolishing a metal film formed on a wafer surface, an electropolishing apparatus according to the present invention comprises a current detector for detecting a current waveform resulting from electropolishing the metal film, and an end point determination part for determining an electropolishing end point of the metal film on the basis of a change of a current detected with the current detector. The electropolishing end point of the metal film in the end point determination part is found by differentiation of a change of the current waveform obtainable in an electropolishing.

According to the electropolishing apparatus, since the electropolishing apparatus comprises the current detector for detecting the current waveform resulting from electropolishing the metal film and the end point determination part for determining the electropolishing end point of the metal film on the basis of the change of the current detected with the current detector, the electropolishing end point can be detected accurately in the same manner as that described in the polishing method of the present invention.

According to the first polishing method of the present invention, since the characteristic feature of the current waveform obtainable in the electropolishing process is used to determine the electropolishing end point of the metal film on the basis of the change of the current waveform resulting from electropolishing the metal film, the electropolishing end point can be determined accurately. Thus, the metal film can be prevented from being electropolished insufficiently or to excess, with the consequence that a desired polish rate can be attained. For this reason, in a process of forming the trench interconnections, it is possible to prevent failures from occurring due to the insufficient interconnection sectional area attributable to recessed interconnection portions as a result of overpolish that will cause a solve-out of even a required interconnection material such as the metal film.

Accordingly, a polish rate equivalent to that in the chemical mechanical polishing is obtained in the electropolishing with a lower pressure than that in the chemical mechanical polishing, so that a substrate of the polished film needs no mechanical strength as much as that applied for the chemical mechanical polishing. For this reason, a novel material having a dielectric constant of not more than 3.0, for instance, such as an organic material of low dielectric constant and a porous insulating film, for instance, is applicable without restriction.

In addition, since the electropolishing assists in a removal of an electric material as compared with the chemical mechanical polishing for a removal of a mechanical material using abrasive grains, there may be obtained a satisfactory polished surface, because of less scratches produced and less film peeling occurred. Further, thanks to no corrosion, no etching and the like, there is no possibility that a resistance of the interconnections is increased with a decreasing interconnection section in a case of forming the trench interconnections, for instance. Furthermore, macro interconnections are prevented from being left behind, with the consequence that a short circuit failure may be prevented from occurring.

According to the second polishing method of the present invention, since the metal film is polished by alternating the electropolishing with the chemical mechanical polishing or chemical buffing, it is possible to obtain a polished surface of a quality as smooth as the surface polished merely by the chemical mechanical polishing or chemical buffing, and also a satisfactory within-wafer uniformity of the polished surface, in addition to the high polish rate. Otherwise, an equivalence of the polish rate permits a polishing with a low pressure. Further, since the electropolishing and the chemical mechanical polishing or chemical buffing are alternated with each other, it is also possible to obtain the high polish rate without losing the quality of the polished surface. Otherwise, an equivalence of the polish rate permits a polishing with a low pressure. Thus, the micro interconnections can be prevented from being disappeared as a result of being centrally electropolished, and the polished surface of the metal film can be also prevented from being roughened due to the variations of the electropolishing conditions.

According to the electropolishing apparatus of the present invention, since the electropolishing apparatus comprises the current detector for detecting the current waveform resulting from electropolishing the metal film, and the end point determination part for determining the electropolishing end point of the metal film on the basis of the change of the current detected with the current detector, the electropolishing end point can be detected accurately in the same manner as described in the polishing method of the present invention.

BRIEF DESCRIPTION OF THE DRAWINGS

The forgoing and other objects and features of the invention will become apparent from the following description of preferred embodiments of the invention with reference to the accompanying drawings, in which:

FIG. 4 illustrates an actual polishing sequence according to a second polishing method of the present invention;

DETAILED DESCRIPTION OF PREFERRED EMBODIMENTS

A preferred embodiment of an electropolishing apparatus according to the present invention will now be described with reference to a schematic view of FIG. 1.

Figure 1:
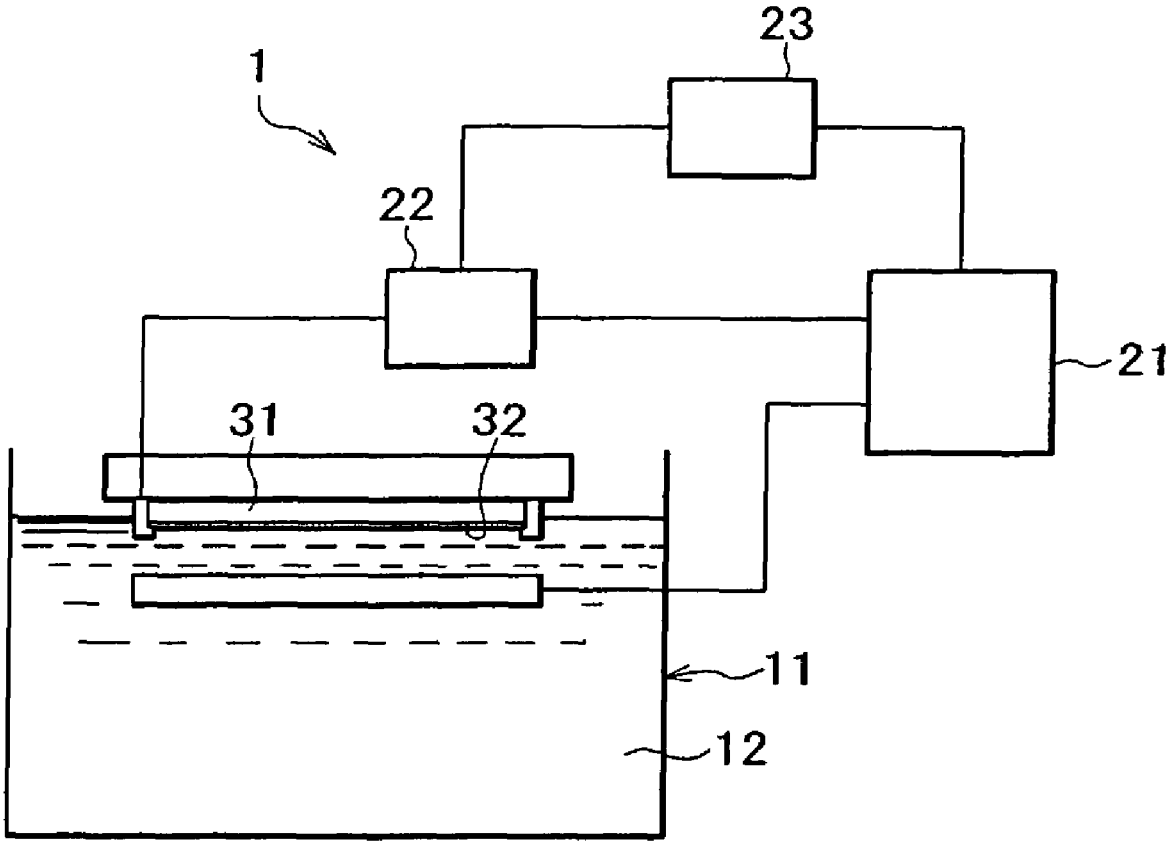
FIG. 1 is a schematic view showing a preferred embodiment of an electropolishing apparatus according to the present invention.

As shown in FIG. 1, an electropolishing apparatus 1 comprises an electropolishing chamber 11 in which an electropolishing solution 12 is reserved. A wafer holder (not shown) is installed in the electropolishing chamber 11 such that a metal film 32 formed on a surface of a wafer 31 is immersed in the electropolishing solution 12. In addition, the electropolishing apparatus 1 also comprises a power supply 21 that a cathode is connected to the wafer 31 and an anode is connected to the electropolishing solution 12. A current detector 22 for detecting a current that flows between the power supply 21 and the anode or the cathode is connected to the power supply 21 and the cathode or anode. An end point determination part 23 for determining an electropolishing end point of the metal film 32 on the basis of a change of a current detected with the current detector 22 is connected to the current detector 22. The end point determination part 23 is also connected to the power supply 21 and commands the power supply 21 to stop an application of a voltage when the electropolishing end point is determined. The electropolishing end point of the metal film 32 in the end point determination part 23 is found by differentiation of a change of a current waveform in an electropolishing, for instance.

Figure 2B:
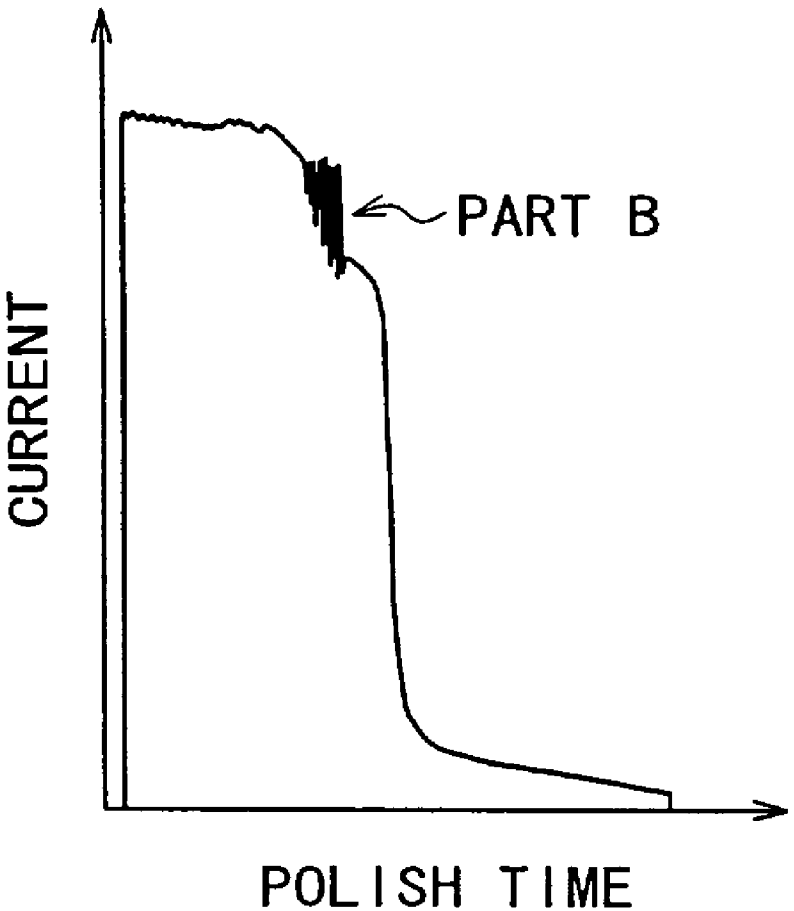
FIGS. 2A and 2B are graphic representation of a relation between a current applied in an electropolishing and a polish time according to a first polishing method of the present invention.

A preferred embodiment of a first polishing method according to the present invention will now be described with reference to a graphic representation of a relation between a current applied in the electropolishing and a polish time in FIGS. 2A and 2B. The electropolishing apparatus as described above with reference to FIG. 1 is used for the first polishing method.

The first polishing method of the present invention relates to a polishing method for electropolishing a metal film formed on a wafer surface so as to fill concave portions formed on the wafer surface, and comprises a step of determining an electropolishing end point of the metal film on the basis of a change of a current waveform resulting from electropolishing the metal film.

For instance, an interconnection trench pattern is formed on an insulating film formed on the wafer surface, and a barrier layer is formed on both of an inner surface of an interconnection trench and a surface of the insulating film. Further, a metal film (a copper film, for instance) is formed on the barrier layer so as to fill the interconnection trench.

Figure 2A:
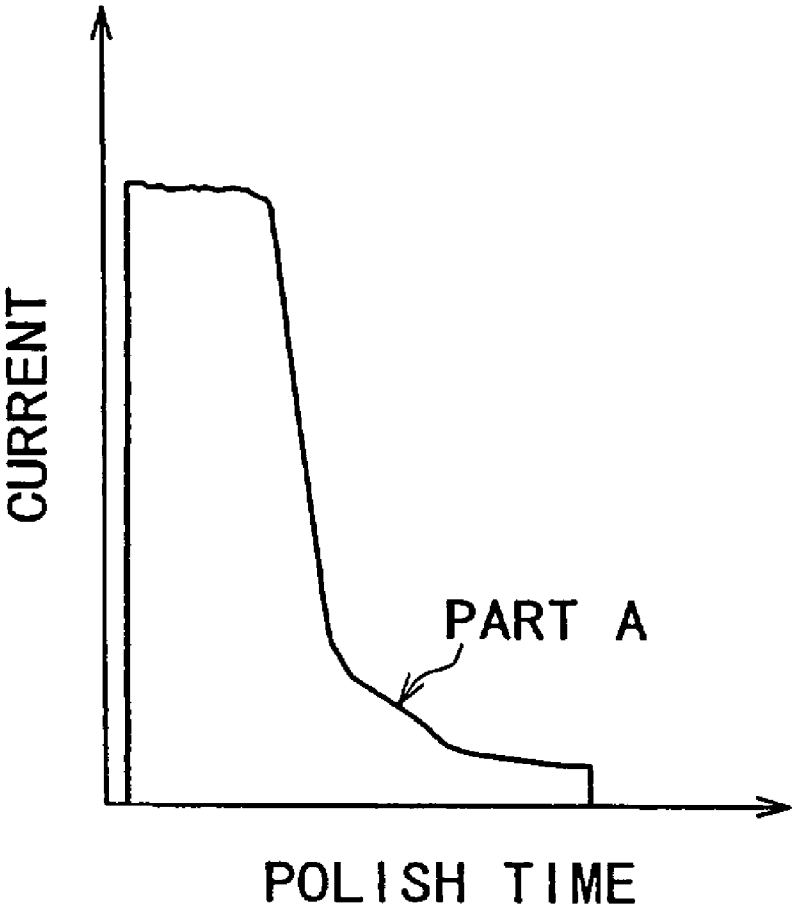

In a case of electropolishing the metal film having the above configuration by making it a condition that a constant voltage is applied, a current applied in the electropolishing provides a characteristic waveform when the barrier layer as a substrate of the metal film is exposed to the outside, as shown in FIG. 2A. In this connection, a detection of the electropolishing end point is conducted by monitoring the current waveform.

For detecting the electropolishing end point, there is provided a means of finding the electropolishing end point by differentiation of the change of the current waveform in the electropolishing, for instance. Then, a point of agreement between a gradient (or a change of a gradient) of a predetermined current waveform at a position of the end point and a gradient (or a change of a gradient) of a measured current waveform is determined as a polishing end point. A determination on the accurate electropolishing end point can be realized by monitoring the current waveform as described above.

Incidentally, a conductive substrate pattern is usually formed on a layer beneath the trench interconnections, and the metal film within each interconnection trench is connected through the conductive substrate pattern, so that a sharp drop of a current value occurs without producing current variations as will be described later with reference to FIG. 2B.

In addition, as shown in FIG. 2A, a current drop rate is decreased (refer to a part A) after the current drops sharply. It does not matter if a portion as shown by the part A may be determined as the polishing end point. Incidentally, in a case of electropolishing the metal film on a so-called solid film formed on a flat surface, the current value varies largely (refer to a part B) only for a certain predetermined period of time before the current begins to drop sharply, as shown in FIG. 2B. This is because any pattern is absent on the substrate, so that resistance variations occur sharply when the metal film is left behind in an insular shape after being polished.

Further, although a state of the wafer entirely covered with the metal film exists in the initial stage of the electropolishing, an approximate quantity of the metal film left behind may be conjectured from a fact that the current value in a case of electropolishing the metal film with a constant voltage applied, for instance, is decreased in proportion to a resistance value that increases with a decreasing thickness of a remaining copper film. A transition to an operation of monitoring a detailed current waveform may be also simplified by setting the monitoring operation so as to be started from a point of time when the resistance value reaches a proper value.

Similarly, the approximate quantity of the metal film left behind may be conjectured from a change of a voltage value also in a case of electropolishing the metal film with a certain current applied, and the same operations may apply to this case.

For forming the interconnections continuously, the electrolytic conditions are changed to other conditions, which permit the metal film to be electropolished without any failures attributable to a centrally conducted electropolishing and the like, in the electropolishing end point detected by the end point detection means according to the first polishing method of the present invention as described above.

That is, since a thick metal film (a copper film) stacked on the wafer needs to be efficiently removed in the beginning of the electropolishing, it is desirable to start the electropolishing under the electrolytic conditions enough to attain a current value as high as possible so far as a glossiness and a flatness of the polished surface are maintainable. However, when the end point is reached under the electrolytic conditions as they are, a disappearance of the interconnections will occur in a moment, because of too high current density for exposed independent interconnections as micro as 1 μm or less. In addition, it is difficult also for interconnections as relatively wide as about 20 to 30 μm to make sure of a sufficient interconnection sectional area, because of a dishing, an erosion and the like that occur under high voltage/current conditions enough to electrolyze the whole surface of the metal film efficiently.

Figure 3:
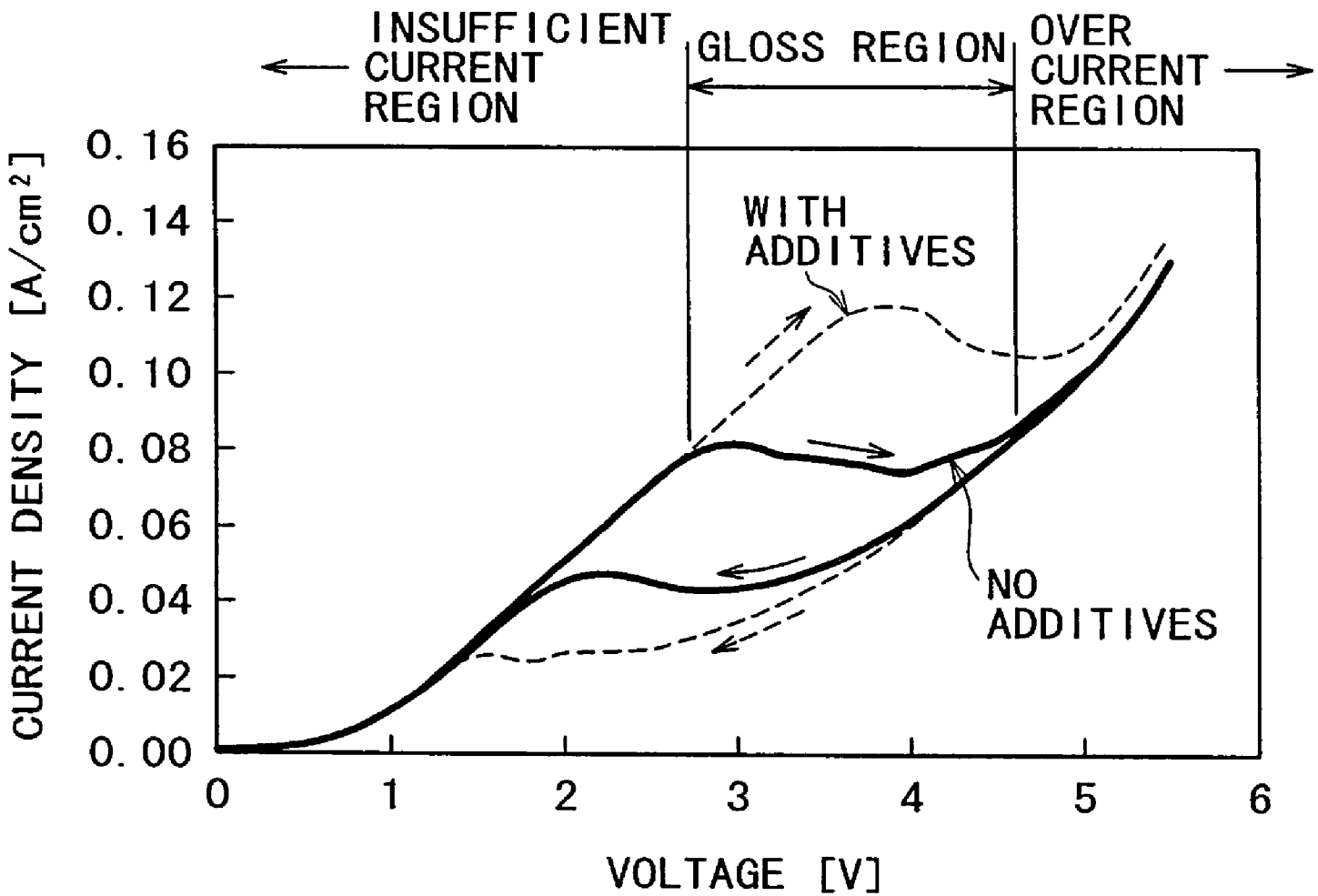
FIG. 3 is a graphic representation of a relation between a current density and an application voltage.

An examination on a range of bright electrolytic solve-out in the process of electropolishing the copper film was made, for instance. As a result, it has proven that the polished surface constitutes a satisfactory glossy surface by electropolishing the copper film with an application voltage set in the range of 2.8 to 4.7 V, when using an electropolishing solution containing additives, for instance, as shown in a graphic representation of a relation between an application voltage and a current density in FIG. 3. On the other hand, when a voltage lower than 2.8 V is applied, no uniform solve-out of the metal (copper) from a superficial layer of the polished surface occurs for lack of the current, so that the polished surface is supposed to be short of a glossy surface. In addition, since the electropolishing is slowed down, a lot of electropolishing time is required. On the other hand, when a voltage higher than 4.7 V is applied, no homogeneous dissolution occurs by reason that gas generated from each electrode acts as an electric resistance. Accordingly, the polished surface constitutes a rough surface. Incidentally, arrows shown in FIG. 3 represent a change direction.

In this connection, for polishing the metal film having been electropolished according to the first polishing method of the present invention, there is provided a method for electropolishing the metal film under the electrolytic conditions changed into other conditions that permit an application of a voltage and a current that are low enough to leave also the micro interconnections behind, after detecting the end point according to the above-mentioned end point detection means. As a result of electropolishing the metal film as described above, it is possible to obtain trench interconnections with the polished surface that constitutes the glossy surface. In this case, the voltage and the current density for the electropolishing are quite low, so that the polishing is slowed down, while the metal film may be left behind within the micro interconnection trench without a disappearance or without an excessive recess of the metal film (the copper film) within the micro interconnection trench. Thus, there may be obtained the glossy surface without increasing an interconnection resistance, with the consequence that the micro trench interconnections can be formed.

For polishing the metal film having been electropolished according to the first polishing method of the present invention, it is also possible to provide a method for polishing the metal film by a polishing process changed to the chemical buffing, after terminating the electropolishing in the end point detected by the above-mentioned end point detection means.

Additives having a slight etching function are added to an electrolytic solution used for the electropolishing, before the electropolishing is terminated in the end point detected by the end point detection means according to the polishing method of the present invention. Thereafter, a final polishing is conducted by means of buffing within the electropolishing solution as it stands.

The electropolishing solution used herein includes an electrolytic solution mainly containing a chelating agent having no oxidizing function, such as an ethylenediamine copper sulfate alkaline bath, a phosphoric acid bath and a pyrophosphoric acid bath, for instance. The electropolishing solution may be appropriated for a chemical buffing solution having no excessive etching function by adding several percents of hydrogen peroxide water or nitric acid as an oxidizing agent to the above-mentioned electropolishing solution.

According to this method, neither the disappearance nor the excessive recess of the metal film (the copper film) within the micro interconnection trench occurs too. Thus, it is possible to obtain the glossy surface without increasing the interconnection resistance, with the consequence that the fine trench interconnections may be formed. In addition, this method has advantages of eliminating a need for processes such as handling and cleaning of the wafer.

As the chemical buffing solution or a copper etching solution appropriated from the electropolishing solution, a solution resulting from diluting a mixture of 400 parts of sulfuric acid, 200 parts of nitric acid, 2 parts of chlorine and 300 parts of water up to several percents or a ferric chloride diluent (an etching solution generally available for a copper printed board) may be also used.

Incidentally, the electropolishing is terminated after the end point is detected according to the first polishing method of the present invention. After a termination of the electropolishing, it is also possible to conduct a wet etching within the etching solution for a finishing.

According to the method for polishing the metal film having been electropolished according to the first polishing method of the present invention, the electropolishing is terminated after the electropolishing end point is detected according to the first polishing method of the present invention. After the termination of the electropolishing, the metal film and the wafer surface are polished by the chemical mechanical polishing (which will be hereinafter referred to as CMP), and as a result, the metal film may be left behind within the micro interconnection trench without the disappearance nor the excessive recess of the metal film (the copper film) within the micro interconnection trench. Thus, it is possible to obtain the glossy surface without increasing the interconnection resistance, with the consequence that the micro trench interconnections may be formed.

A preferred embodiment of a second polishing method according to the present invention will now be described.

The second polishing method of the present invention relates to a polishing method for polishing a metal film formed on a wafer surface so as to fill concave portions formed on the wafer surface, and comprises a step of polishing the metal film by alternating an electropolishing with a CMP or chemical buffing. An electropolishing end point in the second polishing method may be detected in the last electropolishing process among a plurality of electropolishing processes using the end point detection means as described in the first polishing method. Incidentally, in the electropolishing previous to the last electropolishing process, a determination on a polishing end point is made on the basis of a polish time, for instance. It is desirable to find the optimum number of times of the electropolishing and CMP processes by experiments in advance.

As the CMP used herein, a loose abrasive CMP using a slurry containing abrasive grains, a CMP using a fixed abrasive pad, a CMP using an abrasive free slurry and the like may be adopted.

An actual polishing sequence will now be described with reference to FIG. 4.

A sample used for carrying out the polishing sequence has a structure as follows. That is, an insulating film is formed on the wafer surface, and an interconnection trench is formed on the insulating film. A tantalum nitride film is formed as a barrier layer on both of an inner surface of the interconnection trench and the surface of the insulating film. Further, a copper film is formed on the barrier layer so as to fill the interconnection trench using a normally available copper plating technique. The copper film in a portion other than the interconnection trench has a thickness of 1.200 μm.

A polishing sequence shown in ① of FIG. 4 relates to a process in a case where the above-mentioned copper film was polished merely by the CMP, and in this case, the CMP for three minutes was conducted four times by making it a condition that a polishing pressure P is set at 280 g/cm$^2$. Since a quantity of the copper film removed by an individual CMP is supposed to be 300 nm (3000 Å), the copper film having been removed by four times of the CMP amounts to 1.200 μm (12000 Å). Since no electropolishing is conducted in the above process, it is a matter of course that a quantity of the copper film removed by the electropolishing is naught. In the above-mentioned process, when a point of time shown by a black-colored triangular mark was reached, the tantalum nitride film was exposed to the outside. Thus, the last CMP results in overpolish.

A polishing sequence shown in ② of FIG. 4 relates to a process in a case where the above-mentioned copper film was polished merely by a low pressure CMP, and in this case, the CMP for three minutes was conducted sixteen times by making it a condition that a polishing pressure P is set at 60 g/cm$^2$. Since a quantity of the copper film removed by an individual CMP is supposed to be 75 nm (750 Å), the copper film having been removed by sixteen times of the CMP amounts to 1.200 μm (12000 Å). Since no electropolishing is conducted in the above process, it is a matter of course that a quantity of the copper film removed by the electropolishing is naught. In the above-mentioned process, when a point of time shown by a black-colored triangular mark was reached, the tantalum nitride film was exposed to the outside. Thus, the CMP on and after the thirteenth results in overpolish.

A polishing sequence shown in ③ of FIG. 4 relates to a process in a case where the above-mentioned copper film was polished merely by the low pressure CMP after an alternation of the low pressure CMP with the electropolishing until the tantalum nitride film is exposed to the outside, and in this case, the CMP for 3 minutes was conducted eight times in total by making it a condition that a polishing pressure is set at 60 g/cm$^2$, while the electropolishing was conducted five times in total. Since a quantity of the copper film removed by an individual CMP is supposed to be 75 nm (750 Å), the copper film having been removed by eight times of the CMP amounts to 600 nm (6000 Å). In addition, since a quantity of the copper film removed by an individual electropolishing is supposed to be approximately 16.7 nm (166.6 Å), the copper film having been removed by five times of the electropolishing amounts to 83.3 nm (833 Å).

In a case of the process shown in the above-mentioned polishing sequence of ③, a reason why the sum of the quantities of the copper film polished by the CMP and the electropolishing is not equal to the thickness of the copper film is as follows. That is, in the electropolishing, the whole surface of the copper film is not polished uniformly, but a polishing is conducted deeply in a dishing direction in excess of the quantity of the copper film polished. It means that a degeneration layer is deeply formed in excess of the quantity of the copper film polished. Thus, since the degeneration layer is easily formed when the copper film is polished by the CMP, the polishing is supposed to be conducted in excess of the quantity of the copper film polished by the CMP itself even if the low pressure CMP is employed. Accordingly, a surplus copper film is allowed to remove completely, even if the sum of the quantities of the copper film polished by the CMP and the electropolishing is not equal to the thickness of the copper film.

In the process shown in the above-mentioned polishing sequence of ③, when a point of time shown by a black-colored triangular mark was reached, the barrier layer was exposed to the outside. Thus, the last three times of the CMP result in overpolish. In the last electropolishing, the detection of the end point was made using the end point detection means according to the polishing method of the present invention.

Incidentally, referring to FIG. 4, in the normal pressure CMP, a polish time is three minutes, a polish rate is about 100 nm/min, and a quantity polished by the individual CMP is 300 nm. In addition, in the low pressure CMP, the polish time is three minutes, the polish rate is about 25 nm/min, and the quantity polished by the individual CMP is 75 nm. On the other hand, in the electropolishing, the polish time is 10 seconds, the polish rate is 100 nm/min, and the quantity polished by the individual electropolishing is 16.7 nm. In each of the above processes, the polishing on and after a point of time when the barrier layer is exposed to the outside is regarded as overpolish. In addition, a quantity equivalent to 30% of the quantity polished up to that time is determined as a quantity overpolished.

Figure 5:
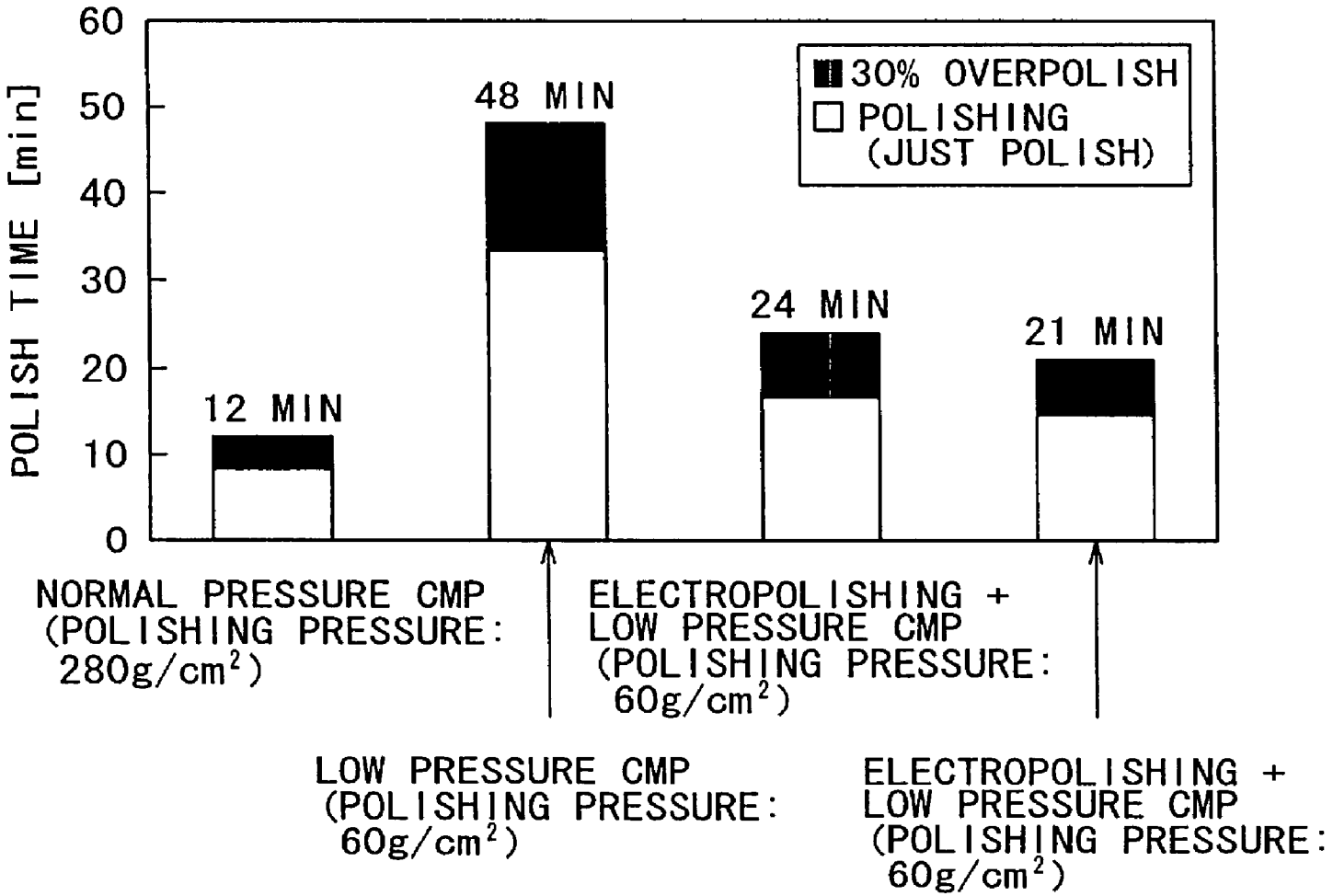
FIG. 5 is a graphic representation of a comparison of a polish time according to each polishing method.

FIG. 5 shows the results of the above processes in the block. As shown in FIG. 5, the CMP under the normal polishing pressure took 12 minutes over the polishing, whereas the problems as described in the related art of the present invention occurred. The CMP under the low polishing pressure took as long as 48 minutes over the polishing, and a remarkable reduction of a throughput occurred. On the other hand, according to the polishing method for polishing by alternating the electropolishing with the CMP, it took 24 minutes in total over the polishing when the individual electropolishing for 5 seconds was conducted, while it took 21 minutes in total over the polishing when the individual electropolishing for 10 seconds was conducted. Thus, it has proven that a highly efficient polishing enough to provide a good polished surface is realized.

Figure 6A:
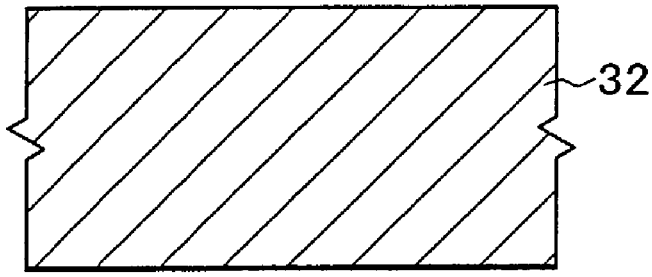
FIGS. 6A to 6C are schematic sectional views each showing a polished state according to the second polishing method of the present invention.
Figure 6B:
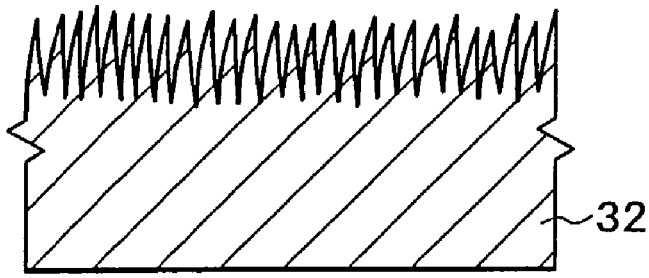
Figure 6C:
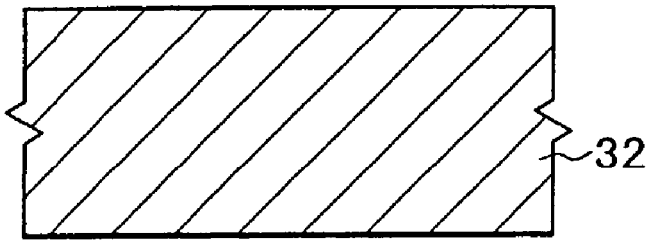

According to the second polishing method, since the metal film is polished by alternating the electropolishing with the CMP or chemical buffing, a smooth surface of the metal film 32 before being electropolished, as shown in FIG. 6A, is degenerated into a porous shape by the electropolishing as shown in FIG. 6B, so that there is provided a roughed surface. Since the metal film having the roughed surface as described above is polished by means of the CMP or chemical buffing, there is obtained a high polish rate in the CMP or chemical buffing. In this case, the polishing pressure of the CMP may be reduced to one seventh to one tenth as low as that in the normal CMP. Thus, even if a generally available fragile film such as an organic film of a low dielectric constant and a porous insulating film of a low dielectric constant is used for the substrate, the CMP may be conducted without breaking the substrate. Then, as a result of polishing by means of the low pressure CMP, the surface of the metal film 32 is finished into a smooth surface, as shown in FIG. 6C.

For instance, in the normal CMP, the polishing pressure is in the range of 27.5 to 48.1 kPa, the polish rate is in the range of 200 to 600 nm/min, a flatness of the polished surface is below or on the average, and within-wafer uniformity is in the range of 3% to 5%. On the other hand, in the low pressure CMP, although the polishing pressure is not more than 6.9 kPa, and the polish rate is not more than 100 nm/min, there may be obtained a good flatness of the polished surface, together with the within-wafer uniformity as much as about 5%.

In addition, as to solve-out characteristics of the electropolishing, when a voltage/current density is as high as not less than 50 mA/cm$^2$, a maximum solve-out rate is 800 nm/min, and the within-wafer uniformity is reduced to not more than 3%. On the other hand, when the voltage/current density is as low as 20 mA/cm$^2$ or less, a solve-out rate is 200 nm/min or less, and the within-wafer uniformity is reduced to 3% or less.

According to the above results, it has proven that it is possible to polish a layer having the roughed surface formed by the electropolishing (which will be hereinafter referred to as the degeneration layer) at a relatively high rate even with a low polishing pressure. In this connection, the highly efficient polishing can be realized by combining the electropolishing with the CMP to alternate the electropolishing and the CMP with each other over a plurality of times.

Figure 7A:
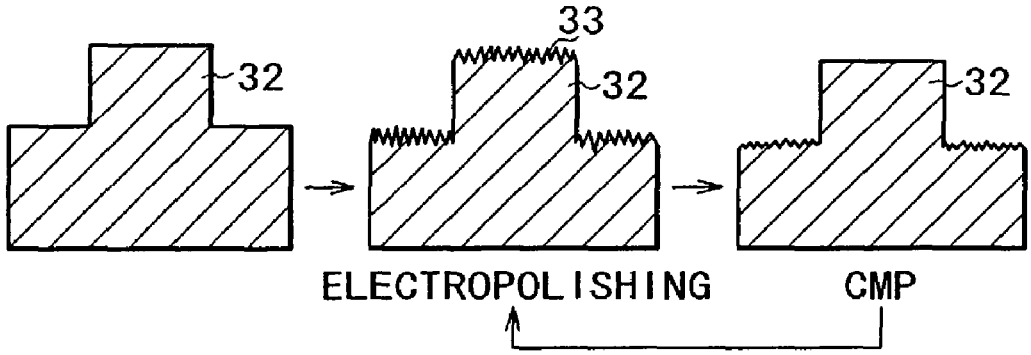
FIGS. 7A to 7C are schematic sectional views each showing various forms of a polished state according to the second polishing method of the present invention.
Figure 7B:
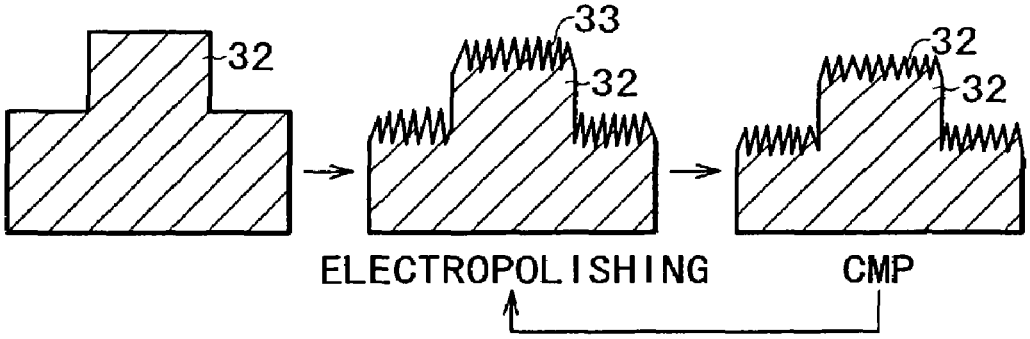
Figure 7C:
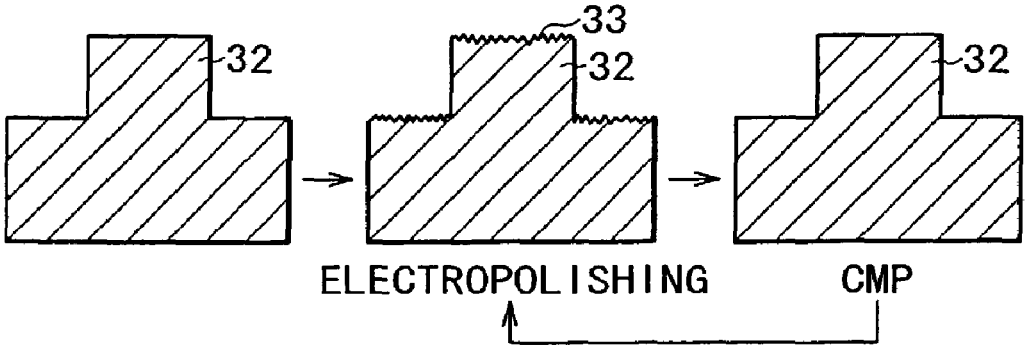

As shown in FIG. 7A, when a degree of the degeneration layer 33 of the metal film 32 formed by the electropolishing and that of the degeneration layer 33 polished by the CMP are well-balanced, it is possible to obtain the polished surface satisfactory to a flatness and a glossiness. On the other hand, as shown in FIG. 7B, when there is provided a thick degeneration layer 33 of the metal film 32 by the electropolishing, it is not possible to polish the degeneration layer 33 completely even by means of the CMP. If the electropolishing and the CMP are alternated with each other repeatedly under the above-mentioned state, the polished surface constitutes an extremely roughed surface, so that there is obtained no polishing effect. In addition, as shown in FIG. 7C, when there is provided an excessively thin degeneration layer 33 of the metal film 32 by the electropolishing, an easy polishing of the degeneration layer is realized by the CMP, whereas it takes too much time to polish the metal film into a desired thickness, and as a result, an improvement on a sufficient polishing throughput cannot be achieved.

As described above, according to the second polishing method, since the roughed surface is polished by the CMP or chemical buffing subsequent to the electropolishing, it is possible to obtain the polished surface as smooth and glossy as the surface polished merely by the CMP or chemical buffing, in addition to the high polish rate. Since the electropolishing and the CMP or chemical buffing are alternated with each other as described above, it is also possible to obtain the high polish rate without losing the quality of the polished surface, so that the improvement on the polishing throughput can be realized.

What is claimed is:

1. A polishing method for electropolishing a metal film formed on a wafer surface comprising:

providing a power supply connected directly or indirectly to a cathode and an anode; and providing a current detector disposed between the power supply and the cathode or the anode for detecting an applied current during electropolishing; and wherein the method further comprises:

electropolishing the metal film; and determining an electropolishing end point based on a change in the rate of change of the current detected during the electropolishing of said metal film, and after detecting said electropolishing end point, continuing electropolishing while reducing the current applied in said electropolishing until a current density in an electropolished surface reaches a predetermined current density or less.

2. The polishing method according to claim 1, wherein said electropolishing end point of said metal film is found by differentiation of said change of said current waveform.

3. The polishing method according to claim 1, further comprising a step of polishing said metal film or both of said metal film and said wafer surface by a chemical buffing subsequent to a termination of said electropolishing, after detecting said electropolishing end point.

4. The polishing method according to claim 1, further comprising a step of polishing said metal film or both of said metal film and said wafer surface by a chemical mechanical polishing subsequent to a termination of said electropolishing, after detecting said electropolishing end point.

5. An electropolishing apparatus for electropolishing a metal film formed on a wafer surface, comprising:

a power supply connected directly or indirectly to a cathode and an anode; and a current detector disposed between the power supply and the cathode or the anode for detecting an applied current that is used during electropolishing said metal film; and an electropolishing end point detector for determining an electropolishing end point of said metal film based on a change in the rate of change of the current detected by the current detector during the electropolishing of said metal film and, wherein said electropolishing end point detector controls the power supply by instructing the supply when to stop an application of voltage, and wherein said electropolishing end point detector continues electropolishing while reducing the current applied in said electropolishing until a current density in an electropolished surface reaches a predetermined current density or less, after detecting said electropolishing end point.

6. The electropolishing apparatus according to claim 5, wherein the electropolishing end point of the metal film in said end point determination part is found by differentiation of said change of the current waveform.

* * * * *